US008262007B2

(12) United States Patent
Okuya

(10) Patent No.: US 8,262,007 B2
(45) Date of Patent: Sep. 11, 2012

(54) OTHER SIDE TOOL SUPPORT BASE AND/OR OTHER SIDE TOOL POST MOUNTED TO CASTING BREAKING APPARATUS, AND BEARING OF THE OTHER SIDE TOOL SUPPORT BASE

(76) Inventor: Yasuaki Okuya, Nishio (JP)

( * ) Notice: Subject to any disclaimer, the term of this patent is extended or adjusted under 35 U.S.C. 154(b) by 536 days.

(21) Appl. No.: 12/309,362

(22) PCT Filed: Jul. 18, 2006

(86) PCT No.: PCT/JP2006/314536

§ 371 (c)(1),
(2), (4) Date: Oct. 30, 2009

(87) PCT Pub. No.: WO2008/010300

PCT Pub. Date: Jan. 24, 2008

(65) Prior Publication Data

US 2010/0059613 A1 Mar. 11, 2010

(51) Int. Cl.
*B02C 1/10* (2006.01)

(52) U.S. Cl. ..... 241/264

(58) Field of Classification Search ..... 241/262–269, 241/101.2

See application file for complete search history.

(56) References Cited

U.S. PATENT DOCUMENTS

| | | |
|---|---|---|
| 5,791,573 A | 8/1998 | Okuya |
| 6,145,768 A | 11/2000 | Okuya |

FOREIGN PATENT DOCUMENTS

| | | |
|---|---|---|
| EP | 0919283 | 6/1999 |
| JP | 2002-224580 | 10/1990 |
| JP | 3-500856 | 2/1991 |
| JP | 6-106083 | 4/1994 |
| JP | 2000-042435 | 2/2000 |
| JP | 2004-195419 A | 7/2004 |
| JP | 2004-223442 | 8/2004 |

OTHER PUBLICATIONS

European Search Report, Oct. 24, 2006, issued in PCT/JP2006/314536.

Supplementary European Search Report for European Patent Application No. EP 06781458.2 issued Nov. 24, 2011.

*Primary Examiner* — Mark Rosenbaum

(74) *Attorney, Agent, or Firm* — Edwards Wildman Palmer LLP

(57) ABSTRACT

A tool support base and a tool post for cutting a casting, in which contact surfaces in sliding contact with both side plates are formed on both sides of the tool support base and the tool post. A cut recess is formed in the sliding contact surface so as to vertically extend in the surface. Deposit welding is applied to the cut recess and a ridge of weld deposit generally flush with the contact surface is formed by grinding means that makes the weld deposit, formed by the deposit welding, flush with the contact surface. The construction minimizes wear of the contact surface as much as possible, and even if particles of casting waste materials enter gaps between the tool support base and the tool post and the side plates, the construction can avoid wear by such particles.

4 Claims, 8 Drawing Sheets

OTHER SIDE TOOL SUPPORT BASE AND/OR OTHER SIDE TOOL POST MOUNTED TO CASTING BREAKING APPARATUS, AND BEARING OF THE OTHER SIDE TOOL SUPPORT BASE

TECHNICAL FIELD

The present invention relates to other side tool support base and/or other side tool post mounted to a casting breaking apparatus of crushing/breaking (defined as breaking) a casting waste of a sprue, a runner, a weir, a failed casting or the like, and a bearing of the other side tool support base.

BACKGROUND ART

With regard to other side tool support base and/or other side tool post mounted to a casting breaking apparatus, and a breaking method (crushing/breaking apparatus) related to a bearing of the other side tool support base and/or the other side tool post of the title, an invention related to a proposal of the applicant has been disclosed in Japan and United States or Europe. Explaining an example thereof, there is present "apparatus of crushing/breaking weir, runner, failed product or the like for casting by hydraulic pressure" of JP-A-6-106083, "method of breaking casting and tool structure" of JP-A-2002-224580 of Japanese Application, or "CRUSHING-BREAKING APPARATUS" of U.S. Pat. No. 5,791,573, or "An apparatus for crushing-breaking useless casting products using a fixed and a rocking cutter device and method for coating said cutting devices" of European Application Publication Patent No. 0919283. Basic structures of the background arts may be explained in outlines (1), (2) shown below.

First, according to outline (1), explaining constitutions of an apparatus, and other side tool post constituting a main body of the apparatus, one side/other side tool apparatus (casting breaking apparatus) upper and lower faces of which are opened is constituted by one side/other side tool support bases, one side/other side tool posts provided at the one side/other side tool support bases, a number of pieces of one side/other side tools in a ridge shape respectively projected in a zigzag shape at the one side/other side tool posts and brought into a fitting relationship, and movable means (cylinder) for making the other side tool support base movable. Further, explaining a crushing/breaking operation (method) of outline (1), a casting waste is crushed/broken (defined as broken) by utilizing a relationship of fitting other tool of other tool post advancing by the cylinder, and one side tool of the one side tool post by throwing in useless sprue, runner, weir, failed casting or the like (defined as casting waste) from a throwing opening (throwing port) (formed between other side tool post and one side tool post) of a casting breaking apparatus in retreating the other side tool post. The other side tool post is made to be movable (advanced or retreated) to be brought into a sliding contact with aside plate of the breaking apparatus. By advancing the other side tool post, the casting waste thrown in the casting breaking apparatus is broken, and by retreating the other side tool post, a broken casting waste broken piece is discharged from a discharge port (outlet) of the casting breaking apparatus by natural dropping.

Further, according to the kind of the apparatus, the other side tool support base and/or the other tool post is brought into sliding contact with the sideplate in being made to be movable, and there is a probability of generating wear (loss) in the face to be slid (sliding face). Further, when a particle or a small piece of the casting waste invades a gap between the other tool base and the side plate, a problem of accelerating a degree of the wear is conceivable.

Next, according to outline (2), explaining an apparatus and a bearing structure of other side tool post constituting a main body of the apparatus, one side/other side tool apparatus (casting breaking apparatus) upper and lower faces of which are opened is constituted by a side plate provided along therewith, one side tool post an upper side of which is axially fixed between the side plates, other side tool post a lower side of which is axially fixed to the side plate, a number of pieces of one side/other side tools in a ridge shape respectively projected in a zigzag shape at the one side/other side tool posts and constituting a fitting relationship, and movable means (cylinder) for making the other side tool post movable. Further, explaining an operation (method) of the one side/other side tool posts of the outline (2), the other side tool post is advanced and retreated by constituting a fulcrum by a portion axially fixed (axially fixed portion). In advancing, the other side tool post breaks the casting waste. Further, in the breaking, a large load is applied to the axially fixed portion, and therefore, a constitution capable of withstanding the load is adopted. Further, there is constructed a constitution in which when a predetermined or more load is applied to the other side tool post, the other side tool post is temporarily retreated, and avoids a failure brought about at an axially fixed portion and/or a portion of the apparatus. However, in a metal structure of the axially fixed portion, with regard to a structure of swiftly repairing a failure when the failure is accidentally brought about, the structure is not regarded to be necessarily sufficient, or to achieve a standardization of maintenance thereof, more or less room for improvement is conceivable.

Further, according to the kind of the metal structure, there is conceivable a problem in which when a particle or a small piece of a casting waste invades an inner portion thereof, a function thereof is deteriorated, and wear of the metal is accelerated.

Further, according to the invention, in the other side tool post mounted to the casting breaking apparatus of the background art, in order to avoid wear of the sliding face, an overlaid reinforcing portion (overlaid streak piece) is worked at the sliding face by welding. With regard to the overlaid reinforcing portion by welding, in the kind of breaking apparatus, an invention of working the overlaid reinforcing portion similarly has been proposed by the applicant. Explaining one example thereof, there is present, for example, "method of coating fixed/moving tools of apparatus of breaking failed product of weir, runner, sprue or the like for casting for producing recycled casting raw material, and fixed/moving tools thereof" of JP-A-2000-42435, or "An apparatus for crushing-breaking useless casting products using a fixed and a rocking cutter device and method for coating said cutting devices" of Europe Application Publication Patent No. 0919283. Basic structures of the background arts will be explained by outline (3) shown below.

According to outline (3), in JP-A-2000-42435, a constitution shown in FIG. 10 discloses a technology of carrying out overlay welding by coating on a sliding face (sliding face of the invention) of a moving base (other side tool support base of the invention) to improve the sliding face constituting a problem of a background art before JP-A-2000-42435 (July 27, Heisei 10). However, the invention is constructed by a constitution of axially supporting an axially fixed portion of other side tool support base by way of a fulcrum bearing mechanism and in order to make the other side tool support base fixed portion smoothly movable, a problem to be improved is pointed out.

DISCLOSURE OF THE INVENTION

As described above, in outlines (1) through (3), the description of the background art and points to be improved of the background art are respectively individually explained.

Hence, the invention intends to ensure maintenance free of the breaking apparatus ultimately while achieving convenience of use of the breaking apparatus and durability of the apparatus by improving the background art. In order to achieve the object, according to the invention, as "1", there is constructed a constitution in which each of sliding faces formed on both sides of the other side tool support base and/or other side tool post is formed with a cut recess streak reaching upper and lower sides of the sliding face, the cut recess streak is subjected to overlay welding, and an overlay weld streak piece substantially in flush with the sliding face is formed by polishing means for making an overlayer of the overlay welding substantially in flush with the sliding face. Further, as "2", there is constructed a constitution in which the axially fixed portion of the other side tool support base provided at the sideplate is a bearing of the other side tool support base constituted by a bearing provided at the side plate, a thin-walled ring-like metal provided at an inner peripheral face of the bearing, and dust seals provided at both ends of the inner peripheral face of the bearing.

ADVANTAGE OF THE INVENTION

The invention is constructed by the constitution in which each of the sliding faces formed on both sides of the other side tool support base and/or other side tool post is formed with the cut recess streak reaching the upper and lower sides of the sliding face, the cut recess streak is subjected to overlay welding, and the overlay weld streak piece substantially in flush with the sliding face is formed by polishing means for making the overlayer of the overlay welding substantially in flush with the sliding face. Therefore, the invention is characterized in capable of achieving prevention of wear of the sliding face of the other side tool support base and/or the other side tool post, and even when a particle or a small piece of the casting waste invades a gap between the other side tool post and the side plate, the invention is capable of effectively preventing wear of the sliding face.

Next, the invention is constructed by a constitution in which both end portions in a longitudinal direction of the sliding face (direction reaching a lower end from an upper end thereof) are formed with overlay weld streak pieces substantially in flush therewith. Therefore, the invention is characterized in capable of firmly reducing wear of a portion of the other side tool post liable to receive an impact the most, and capable of effectively preventing wear of the sliding face by reducing a particle, or a small piece of the casting waste invading a gap between the other side tool post and the side plate.

The invention is further characterized in that an axially fixed portion of the other side tool support base is constituted by a metal structure, when a failure is brought about accidentally, a structure of capable of being repaired swiftly is constituted, or standardization of a maintenance thereof is achieved or the like. Further, in the kind of metal structure, there is achieved an advantage in which when a particle or a small piece of the casting waste invades an inner portion thereof, a structure of not deteriorating a function thereof is constituted, a structure of not accelerating wear of the metal can be provided or the like.

The invention achieves an advantage in which the object of the invention as further characterized above can be achieved, or a metal structure optimum and effective in achieving the object can be provided.

The invention achieves an advantage in which the object of the invention as further characterized above can be achieved, and a dust seal optimum and effective for achieving the object can be provided or the like.

BRIEF DESCRIPTION OF THE DRAWINGS

First, explaining the drawings,

FIG. 10 is a rear schematic view of FIG. 8. Further, FIG. 11 is a perspective view of explaining a state of forming a cut recess streak at a sliding face of other side tool support base and/or other side tool post.

FIG. 12 is an enlarged front view constituting a section by a portion of an axially fixed portion of other side tool apparatus.

BEST MODE FOR CARRYING OUT THE INVENTION

Figure 1:
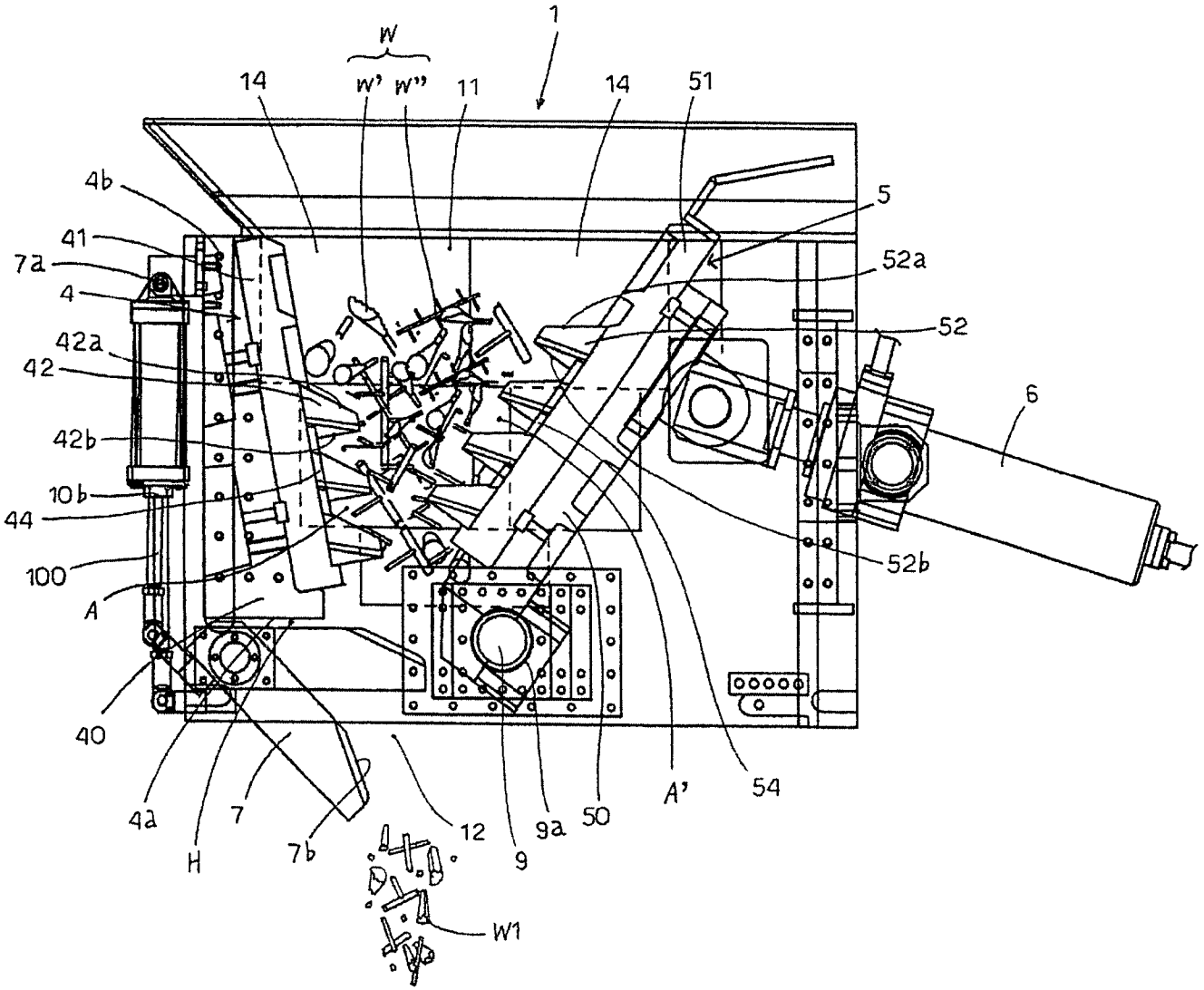
FIG. 1 is a reduction scale side schematic view of a total of a breaking apparatus.

A basic structure of a breaking apparatus of the invention is shown in FIG. 1 through FIG. 4, explaining an example thereof, numeral 1 designates a breaking apparatus (crushing and/or breaking apparatus) of a casting waste, and the breaking apparatus 1 constitutes main constituent elements by a frame 3 upper and lower sides of which are opened constituted by side plates 2*a*, 2*b* and a bridging plate 2*c*, one side tool apparatus 4 (fixed tool apparatus) and other side tool apparatus 5 (moving tool apparatus) provided at the frame 3, a cylinder 6 of advancing and retreating the other side tool apparatus 5, and a damper 7.

First, the one side tool apparatus 4 is constituted by one side tool support base 40 provided at the frame 3 for attaching a tool post, one side tool post 41 attachably and detachably provided at the one side tool support base 40, and a number of pieces of one side tools 42 (receive tools, or press tools) for crushing/breaking in a shape of a truncated cone provided in a zigzag shape at the one side tool base 41. Further, a curved face shape inclined face 42*a* of the one side tool 42 in the truncated cone shape is provided with an inclination by which a broken casting (broken casting which can be reutilized) can firmly and naturally be dropped. The one side tools 42 are arranged in the zigzag shape, and a space A capable of fitting other side tool 52 in a truncated cone shape of the other side tool apparatus 5 mentioned later is formed between the one side tools 42, and the other side tool 52 of the other side tool apparatus 5 mentioned later is fitted to the space A. The broken casting is dropped in a fitting gap formed by the other side tool 52 of the other side tool apparatus 5 fitted to the space A, and the one side tool 42 of the one side tool apparatus 4. Further, a bottom side 42*b* of the one side tool 42 is provided with a bottom side ridge portion 43 projected in a ridge-like shape. The bottom side ridge portion 43 can achieve efficient breaking and/or cutting, crushing or the like of a casting waste, a casting product, other casting (defined as raw material W) or the like and prevention of squeezing a recycled casting W1 (recycled casting/raw material for casting) between the one side tool 42 and/or the other side tool 52, and therefore, for example, the bottom side ridge portion 43 is effective in breaking and/or cutting of a lump-like raw material W' and breaking of an elongated raw material W". Further, the bottom side ridge portion 43 is characterized in capable of achieving prevention of scattering of the recycled casting W1, pressing (pressing stress) of the recycled casting W1 present in middle of the breaking apparatus 1 to a discharge port 12 of the breaking apparatus 1 (to a lower side) and breaking thereof (breaking force) simultaneously. In the drawing, numeral 44 designates a rib shape tool provided between the one side tools 42 for breaking/cutting. Further, the rib shape tool 44 is effective in breaking and pressing to the lower side, or reinforcing the one side tool 42 and/or other side tool 52 or the like.

The other side tool apparatus 5 is constituted by other side tool support base 50 provided to be movable (able to advance or retreat) by way of an axially fixed portion 8 provided on a lower side of the frame 3 (fulcrum 5*a* on a lower side), other side tool post 51 attachably and detachably provided to the other side tool support base 50 and a number of pieces of the other tools 52 (press tools) for crushing/breaking in a truncated cone shape provided in a zigzag shape on the other side tool post 51. Further, a curved face shape inclined face 52*a* of the other side tool 52 in the truncated cone shape is provided with an inclination by which the recycled casting W1 can firmly and naturally be dropped. The other side tools 52 are arranged in the zigzag shape, and a space A' of the other side tools 52 is fitted with the one side tool 42 in the truncated cone shape of the one side tool apparatus 4 (other side tools 52 and one side tools 42 inserted between the spaces A and spaces A'). Further, a bottom side 52*b* of the other side tool 52 is provided with a bottom side ridge portion 53 projected in a ridge shape. The bottom side ridge portion 53 can achieve efficient breaking and/or cutting, crushing or the like of the casting waste, the casting product, other casting (defined as raw material W) or the like and prevention or the like of squeezing the recycled casting W1 (recycled casting/raw material for casting) between the other side tools 52 and/or one side tools 42, and therefore, the bottom side ridge portion 53 is effective in breaking and/or cutting of the lump-like raw material W' and breaking of the elongated raw material W". Further, the bottom side ridge portion 53 is characterized in capable of achieving prevention of scattering of the recycled casting W1, pressing (pressing stress) of the recycled casting W1 present in the middle of the breaking apparatus 1 to the discharge port 12 of the breaking apparatus 1 (to lower side) and breaking (breaking force) simultaneously. In the drawing, numeral 54 designates a rib shape tool for crushing/breaking provided between the other side tools 52. Further, the rib shape tool 54 is effective in breaking and pressing to the lower side, or reinforcing the other side tool 52 and/or the one side tool 42 or the like.

Further, side faces 50*a*, 51*a* of the other side tool support base 50 and/or other side tool post 51 of the other side tool apparatus 5 constitute sliding faces 500, 510 brought into contact with the side plates 2*a*, 2*b* (left and right ones thereof are the same, and explanation will be given of one side thereof). Further, a cut recess portion 500*a* is recessed in a longitudinal direction of the sliding face 500 of the other side tool support base 50, overlay welding is carried out by utilizing the cut recess portion 500*a*, and an overlay welding streak piece 500*b* substantially in flush with the sliding face 500 is formed by polishing means for making overlayer of overlay welding substantially in flush with the sliding face 500. As means of recessing the cut recess portion 500*a*, the cut recess portion 500*a* is continuously fabricated by utilizing a jig shown in FIG. 11. Further, as the polishing means, polishing is carried out by a grinder, a working machine, a robot operation or the like. Further, a cut recess portion 510*a* is recessed in a longitudinal direction of the sliding face 510 of the other side tool post 51, overlay welding is carried out by utilizing the cut recess portion 510*a*, and an overlay streak piece 510*b* substantially in flush with the sliding face 510 is formed by polishing means of making an overlayer of the overlay welding substantially in flush with the sliding face 510. As a method of recessing the cutting recess portion 510*a*, the cut recess portion 510*a* is fabricated continuously by utilizing the jig shown in FIG. 11 which is used to assist. The other corresponds to the above-described example. Further, an increase in strengths of the other side tool support base 50 and the other side tool post 51 and avoidance of chip off thereof are achieved by a synergetic effect of hardening by quenching in working the cut recess portions 500*a*, 510*a*, hardening by overlay welding, hardening by polishing means of making the sliding faces 500, 510 substantially in flush therewith or the like.

Further, numeral 13 in the drawings designates a hole for a fastening piece for attaching the one side and the other side tool posts 41, 51 to the one side and the other side tool support bases 40, 50.

Further, the axially fixed portion 8 is constituted by a fulcrum bearing 80 provided at the side plate 2*a*, a thin-walled ring-like metal 81 provided at an inner peripheral face 80*a* of the fulcrum bearing 80, and a dust seal 82 provided at both ends 80*b*, 80*c* of the inner peripheral face 80*a* of the fulcrum bearing 80. An axial shaft 9 is supported by the fulcrum bearing 80 by way of the ring-like metal 81. Therefore, a load applied to the other side tool support base 50 is transferred to the axial shaft 9, however, the axial shaft 9 is supported by the fulcrum bearing 80 by way of the ring-like metal 81 and is constituted by a structure of capable of sufficiently withstanding the load. Thereby, there is provided a characteristic of capable of ensuring a durability of the axially fixed portion 8, further, avoidance of a failure of the axially fixed portion 8, or a reduction in noise, further, being effective in resolving squeak or the like. Further, as in the illustrated example, by constituting the ring-like metal 81 as a divided type for achieving to facilitate to interchange, low cost formation or the like and achieving to switch a portion applied with a load and easy to be worn, it is intended to contribute to a reduction in cost, a reduction in an interchanging frequency, and an effectiveness in maintenance. Further, the axial shaft 9 constituting the axially fixed portion 8 is concealed by way of an attachable and detachable plate 90. Further, the other side tool support base 50 is provided with a notched portion 9*a* for inserting the axial shaft 9.

Further, at a fulcrum 5*b* on an upper side of the other side tool apparatus 5, the other side tool apparatus 5 is made to be movable (move) by constituting a support axis by the axially fixed portion 8 by way of expansion and contraction of a piston rod 61 of the cylinder 6. That is, the other side tool 52 on the moving side is brought into contact with and separated from the one side tool 42 on the fixed side, further, the piston rod 61 is axially fixed to the upper side of the other side tool support base 50, and therefore, a lever motion mechanism is constituted by the axially fixed portion 8 (fulcrum) and the upper position at which the piston rod 61 is axially supported, and the other side tool support base 50 is pressed by the lever motion mechanism. Further, although not illustrated, the piston rod 61 can also be supported by an axial shaft of the ring-like metal structure.

The damper 7 is provided with a small space H from a horizontal lower end bottom portion 4*a* of the one side tool apparatus 4, and movably by an axial shaft 7*a* provided at an inner side of the frame 3 more than a fulcrum shaft 4*b* of the one side tool apparatus 4, and the movement is carried out by utilizing a pneumatic cylinder 10. The pneumatic cylinder 10 is a cantilever having a fulcrum shaft 10*a* on an upper side of the frame 3, and a piston rod side 10*b* thereof is movably provided. Further, a pneumatic pressure of the pneumatic cylinder 10 can be adjusted by a valve, a constitution of capable of dealing with a load necessary for the damper 7 is adopted to govern automatic opening and closing of the damper 7. Therefore, for example, when the recycled casting W1 is piled up to the damper 7, and the pneumatic pressure is increased more than a set pneumatic pressure, the damper 7 is lowered automatically and the discharge port 12 is opened. Thereby, resolving the load on the damper 7 and firm discharge are achieved. By cooperating the discharge and the movableness of the other side tool apparatus 5, there is achieved an advantage of efficient and firm breaking, smooth throwing of the raw material W, smooth discharge of the recycled casting W1. Further, the discharge of the recycled casting W1 from the discharge port 12 is carried out smoothly by way of a forward lowering inclination 7*b* provided at the damper 7. Further, by providing the damper 7 at the discharge port 12, dropping of the elongated raw material W" can be avoided, and avoidance of the dropping is further achieved by the synergetic effect with a welding rib (not illustrated) provided at the damper 7. The welding rib is characterized in being formed in overlay in series in a linear shape or an inclined shape or the like by welding normally in a longitudinal direction of the damper 7, or a direction orthogonal to the longitudinal direction (dropping direction), increasing a strength thereof, preventing destruction/wear, being utilized as a breaking tool or the like. Further, as described above, the damper 7 is provided with the small space H from the horizontal lower end bottom portion 4*a*, and the damper 7 is provided movably by way of the axial shaft 7*a*.

Further, there is adopted a constitution in which one sheet or a plurality of sheets of liners 14 are provided at the side plates 2*a*, 2*b* attachably and detachably by fastening pieces, and heads of the fastening pieces are worked substantially in flush therewith by polishing means to constitute an object of an increase in a durability and a long term use of the side plates 2*a*, 2*b*. Further, the liners 14 are constituted to be soft to avoid a friction with the one side and/or other side tool apparatus 4, 5 and eliminate impact of the raw material W and the recycled casting W1 to the side plates 2*a*, 2*b*. Further, there is achieved avoidance of a shock by impact of the raw material W and the recycled casting W1 to the liners 14.

Next, a method for carrying out the invention will be explained. First, in FIG. 1 through FIG. 4, under a situation in which the other side tool apparatus 5 is disposed at a retreat limit, the raw material W is thrown in from an throwing opening 11 formed by opening the upper side of the other side tool support base 50 and/or the other side tool post 51 (defined as other side tool post 51) of the other side tool apparatus 5 and opening the upper side of the one side tool support base 40 and/or the one side tool post 41 (defined as one side tool post 41) of the one side tool apparatus 4. By receiving a comparatively slender raw material (elongated raw material W") of the thrown raw material W dropped from between the one side/other side tools 42, 52 (defined as between two tools) by the damper 7, the raw material W and/or the elongated raw material W" mentioned later is firmly received and firmly and efficiently broken.

Figure 2:
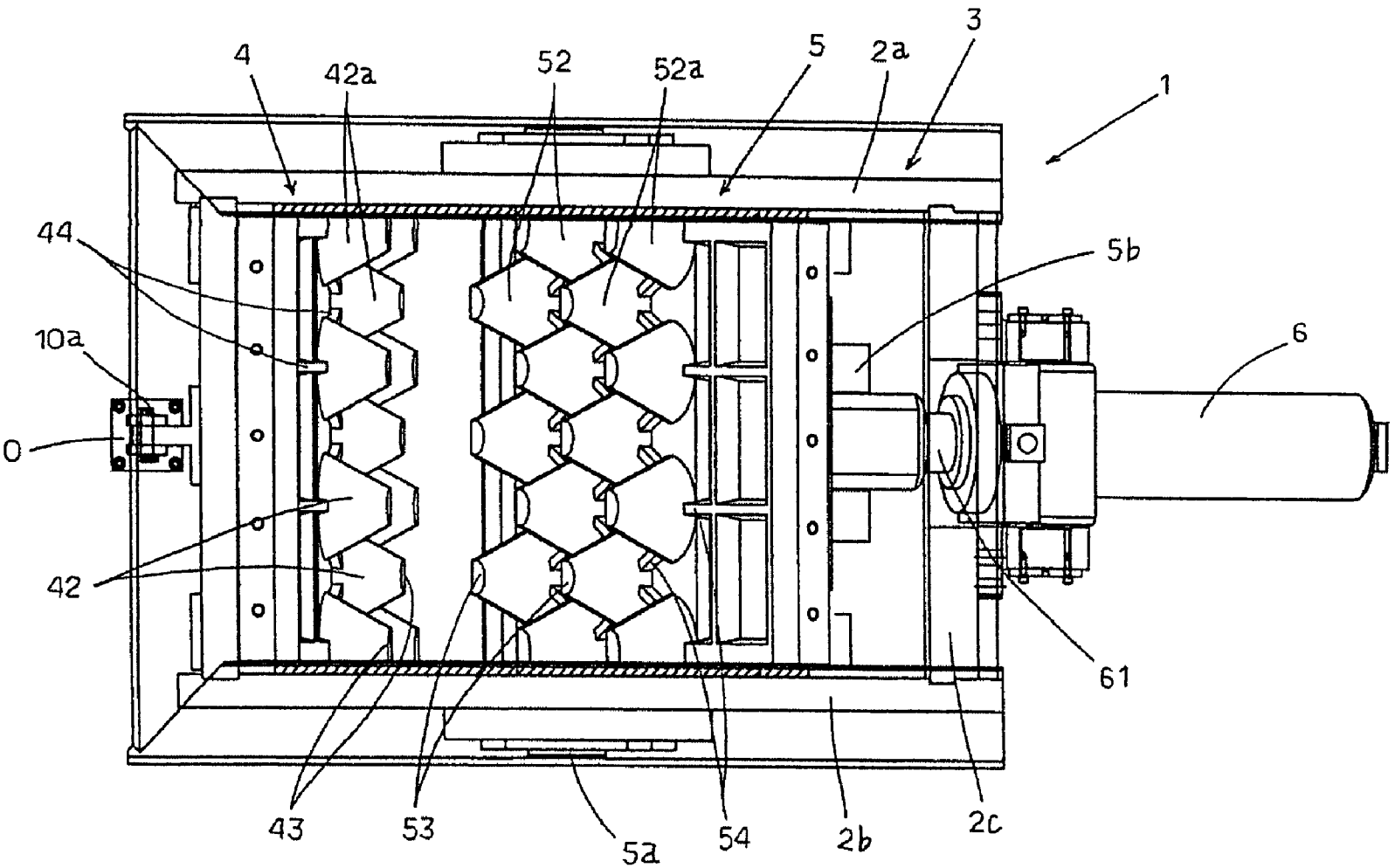
FIG. 2 is a plane schematic view of FIG. 1.
Figure 3:
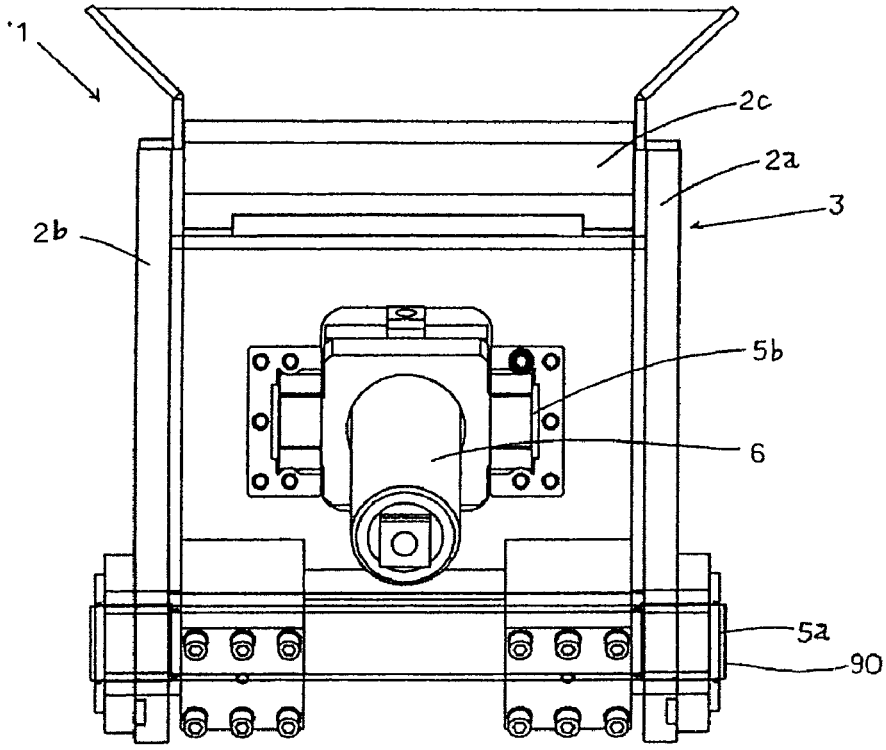
FIG. 3 is a front schematic view of FIG. 1.
Figure 4:
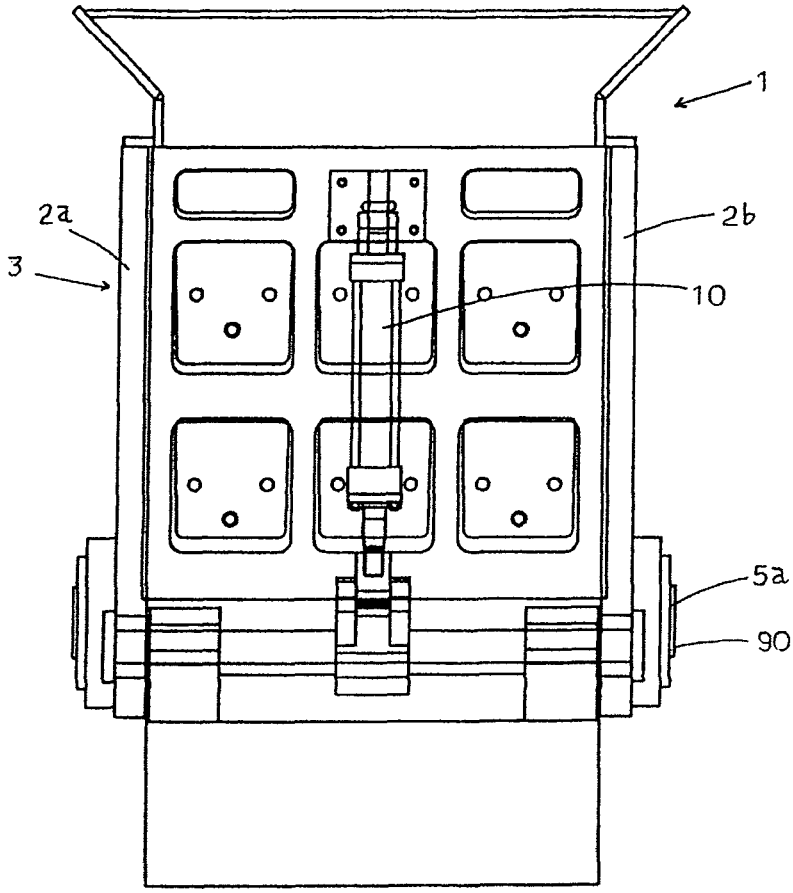
FIG. 4 is a rear schematic view of FIG. 1. Further.
Figure 5:
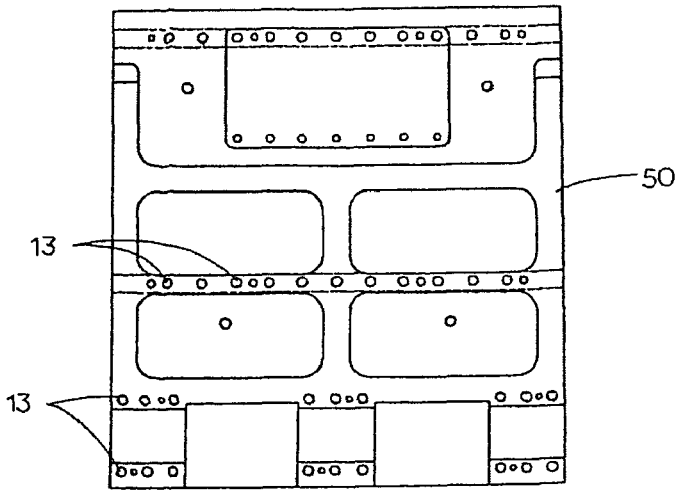
FIG. 5 is a front schematic view, showing a total of other side tool support base.
Figure 6:
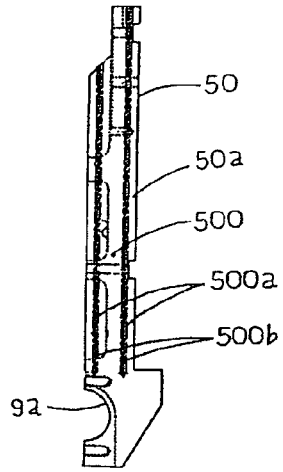
FIG. 6 is a side schematic view of FIG. 5.
Figure 7:
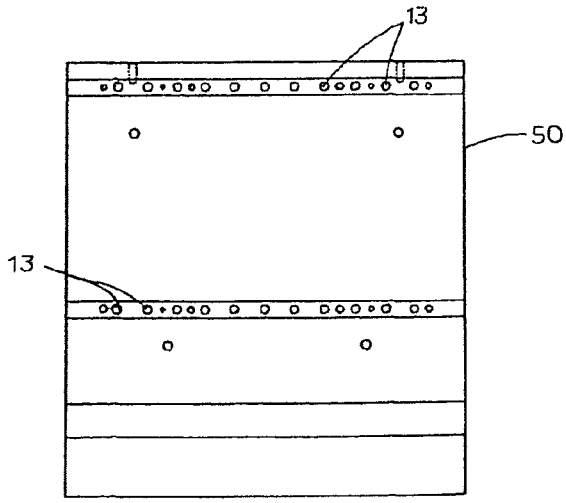
FIG. 7 is a rear schematic view of FIG. 5. Further.
Figure 8:
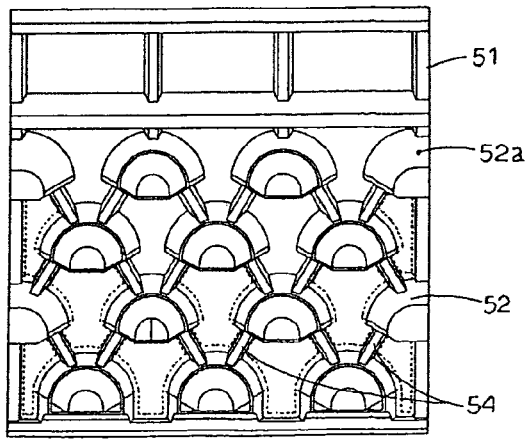
FIG. 8 is a front schematic view showing a total of other side tool post.
Figure 9:
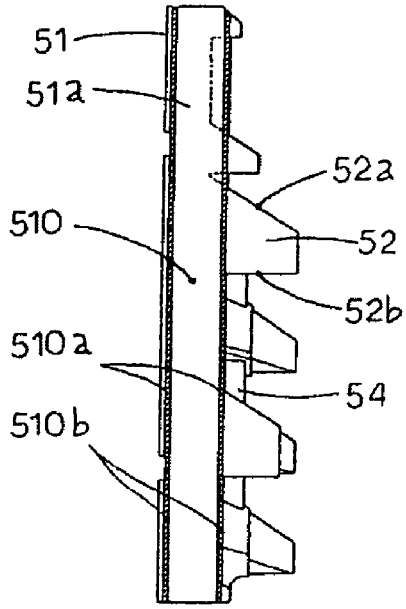
FIG. 9 is a side schematic view of FIG. 8.
Figure 1:
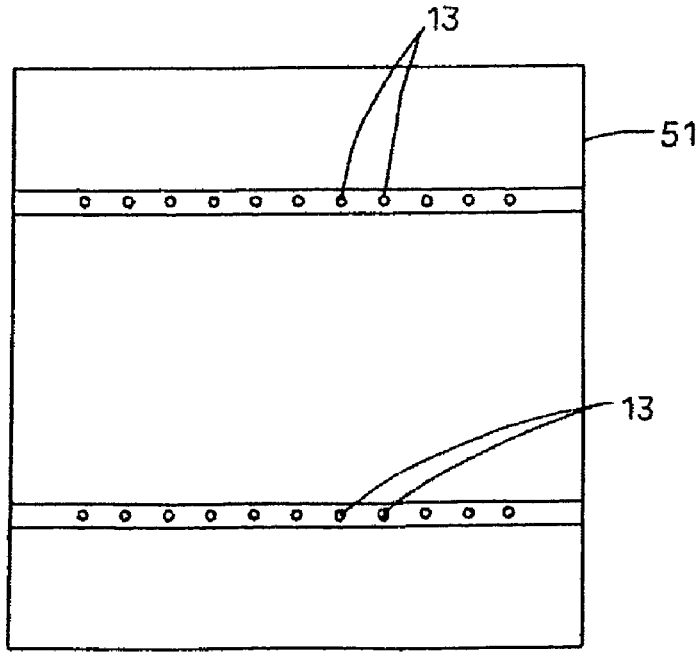
Figure 1:
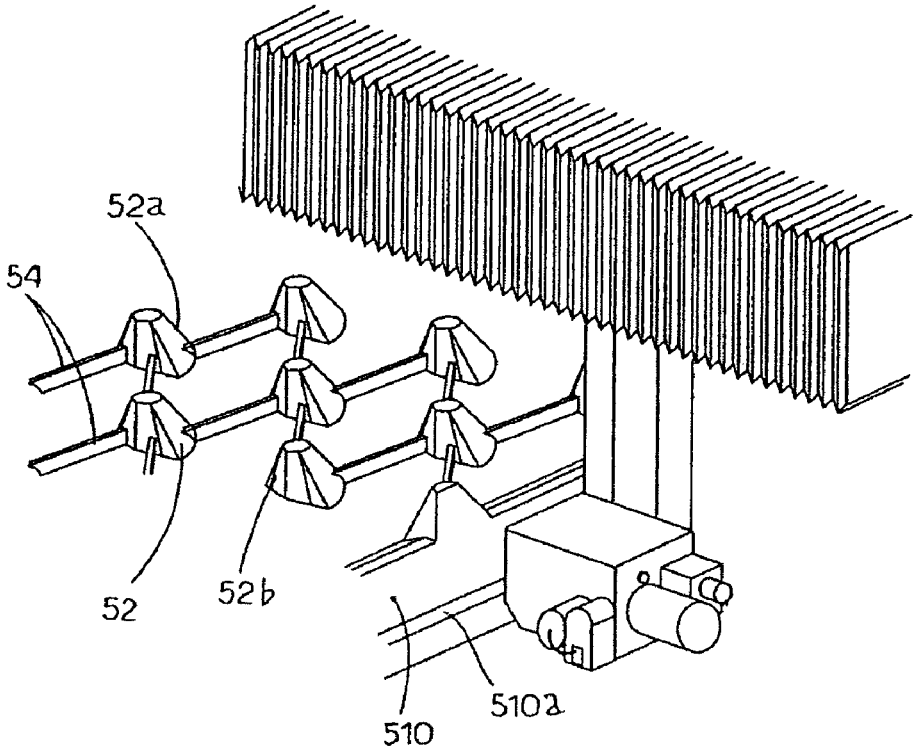
Figure 1:
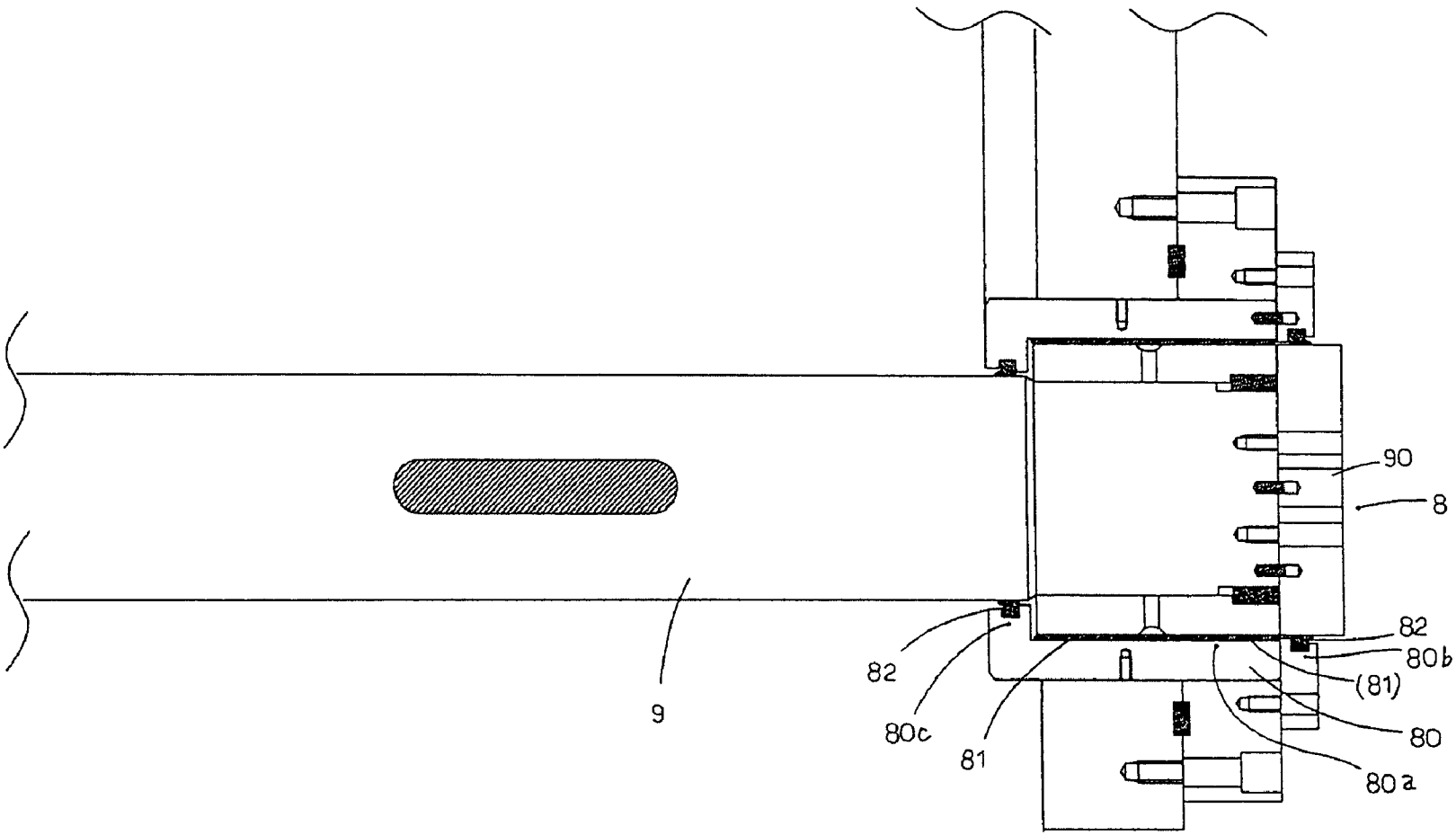

Further, as shown by FIG. 1 and FIG. 2, by moving to advance the other side tool apparatus 5 along a circular arc locus by constituting the fulcrum by the axially fixed portion 8 on the lower side, operating substantially all of press force of the pneumatic cylinder 10 to the fulcrum shaft 10*a* on the upper side of the other side tool 52, operating the press force between the two tools at vicinities thereof, and moving to advance along the circular arc locus, a strong crushing force and/or breaking force (defined as breaking force) is generated from a principle of a lever between the two tools on the upper side of the discharge port 12 at the vicinity of the axially fixed portion 8 on the lower side, the raw material W thrown from the throwing opening 11 is firmly and smoothly broken. The breaking is carried out by utilizing the fitting relationship of the two tools. The breaking achieves an advantage useful for downsizing a total of the apparatus, or a reduction in running cost by carrying out the breaking firmly and by a low pressure force by way of the axially fixed portion 8 and the fulcrum shaft 10*a* on the upper side and the pneumatic cylinder 10 and adopting such a constitution. Further, the axially fixed portion 8 is characterized in being moved smoothly by way of the ring-like metal 81 and the fulcrum bearing 80 and ensured with a load resistance. Further, the broken recycled casting product (recycled casting W1) is naturally dropped successively to the discharge port by way of surfaces of the two tools and/or a gap therebetweeen. Further, according to the invention, the damper 7 is naturally opened when applied with a predetermined load.

Thereafter, although not illustrated, the other side tool apparatus 5 disposed at an advance limit is retreated by way of expansion and contraction of a piston rod 100 of the cylinder 6 and the operation is finished by reaching the retreat limit as it is.

However, generally, when the raw material W is present between the two tools (partially including recycled casting W1), the other side tool apparatus 5 is advanced again to repeat the breaking operation similar to the above-described. That is, when the raw material W is present between the two tools, advance and retreat of the other side tool apparatus 5 are repeated. Further, when the raw material W is not present between the two tools, as a rule, in a state of the retreat limit, a new raw material W is thrown to the throwing opening 11 similar to the above-described.

DESCRIPTION OF REFERENCE NUMERALS AND SIGNS

1 crushing and/or breaking apparatus
2*a* side plate
2*b* side plate
2*c* bridging plate
3 frame
4 one side tool apparatus
4*a* horizontal lower end bottom portion
4*b* fulcrum shaft
40 one side tool support base
41 one side tool post
42 one side tool
42*a* inclined face
42*b* bottom side
43 bottom side ridge portion
44 rib shape tool
5 other side tool apparatus
5*a* lower side fulcrum
5*b* upper side fulcrum
50 other side tool support base
50*a* side face
500 sliding face
500*a* cut recess portion

500*b* overlay welding streak piece
51 other side tool post
51*a* side face
510 sliding face
510*a* cut recess portion
510*b* overlay welding streak piece
52 other side tool
52*a* inclined face
52*b* bottom side
53 bottom side ridge portion
54 rib shape tool
6 cylinder
61 piston rod
7 damper
7*a* axial shaft
7*b* forward lowering inclination
8 axially fixed portion
80 fulcrum bearing
80*a* inner peripheral face
80*b* end
80*c* end
81 ring-like metal
82 dust seal
9 axial shaft
9*a* notched portion
90 plate
10 pneumatic cylinder
10*a* fulcrum shaft
10*b* piston rod side
100 piston rod
11 throwing opening
12 discharge port
13 hole
14 liner
A space
A' space
H space
W raw material
W' lump-like raw material
W" elongated raw material
W1 recycled casting

INDUSTRIAL APPLICABILITY

As described above, the invention can provide the other side tool support base and/or other side tool post mounted to the cast breaking apparatus of crushing/breaking (defined as breaking) the casting waste of a sprue, a runner, a weir, a failed casting or the like, and the bearing of the other side tool support base, and therefore, the invention is characterized in being useful for a casting business field and an industrial field.

The invention claimed is:

1. A crushing/breaking apparatus including:

a frame including a pair of frame side plates, a one side tool apparatus fixed to the frame between the side plates;

an other side tool apparatus disposed between the side plates and opposite the one side tool apparatus and moveable relative to the frame via a cylinder, wherein the other side tool apparatus includes an other side tool support base and an other side tool post each of the other side tool support base and other side tool post disposed between the pair of frame side plates, wherein at least one of the other side tool post and other side tool support base include a pair of sliding faces configured for sliding contact with respective slide frame side plates, the sliding faces each including a beveled/recessed portion extending along a length of the sliding faces, the beveled/recessed portions including an overlay weld thereon, and wherein the overlay weld is polished to be substantially flush with the sliding faces.

2. The crushing/breaking apparatus of claim 1, wherein the beveled/recessed portions and overlay welds extend along a length of the sliding faces of the other side tool support base and the other side tool post.

3. The crushing/breaking apparatus of claim 1, wherein frame side plates comprise a detachable liner.

4. The crushing/breaking apparatus of claim 3, wherein the other side tool apparatus is rotatable about a fulcrum via the cylinder at the frame side plates, the fulcrum comprising a bearing at each of the frame side plates, a thin-walled ring-like metal provided at an inner peripheral face of each bearing, and dust seals provided at both ends of the inner peripheral face of each bearing.

* * * * *